United States Patent [19]

Beeghly

[11] 4,277,724

[45] Jul. 7, 1981

[54] INTEGRAL SPARK PLUG COIL FOR AUTOMOTIVE-TYPE PLUG

[75] Inventor: Bruce R. Beeghly, Youngstown, Ohio

[73] Assignee: The Economy Engine Company, Youngstown, Ohio

[21] Appl. No.: 85,898

[22] Filed: Oct. 18, 1979

[51] Int. Cl.[3] ..... H01J 7/44; H01J 17/34; H01J 19/78; H01K 1/62

[52] U.S. Cl. ..... 315/57; 123/169 R; 313/120; 313/143; 315/70

[58] Field of Search ..... 315/57, 58, 59, 70; 313/120, 143; 123/169 R

[56] References Cited

U.S. PATENT DOCUMENTS

| | | | |
|---|---|---|---|
| 2,070,708 | 2/1937 | Brokaw | 313/120 |
| 2,266,614 | 12/1941 | Robinson | 315/57 |
| 2,467,531 | 4/1949 | Lamphere et al. | 315/57 |
| 2,632,132 | 3/1953 | Delano | 315/57 |
| 3,012,084 | 12/1961 | Fisher | 313/120 |
| 3,330,985 | 7/1967 | Johnston | 313/120 |
| 4,090,125 | 5/1978 | Warner | 315/57 |

*Primary Examiner*—Saxfield Chatmon, Jr.
*Attorney, Agent, or Firm*—Webb, Burden, Robinson & Webb

[57] ABSTRACT

An integral spark plug coil comprising a step-up coil within a canister which canister is mounted to a unique double-walled container. The container fits over the neck of the spark plug and is secured to the shell of the spark plug. An inner ceramic bushing is arranged within a metal sleeve defining the outer wall of the container. The space adjacent the neck of the spark plug is in communication with the exterior of the metal sleeve through the small quenched space defined by the inner diameter of the sleeve and the outer diameter of the ceramic bushing and through ports in the sleeve located generally outward of the terminal end of the neck of the spark plug.

4 Claims, 1 Drawing Figure

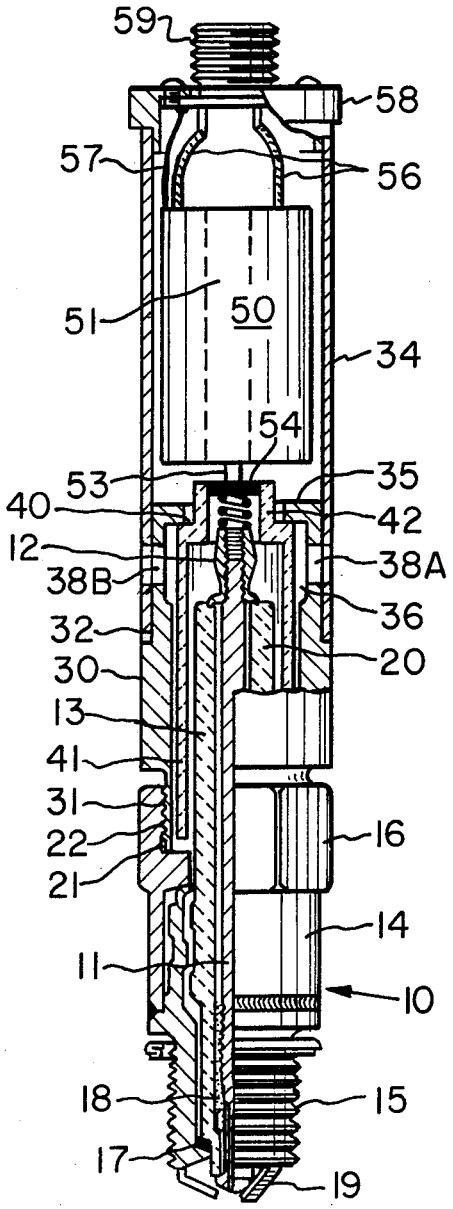
59
58
57
56
51
50
34
54
53
35
40
42
12
38A
38B
36
32
20
30
13
41
31
16
22
21
14
11
10
18
15
17
19

INTEGRAL SPARK PLUG COIL FOR AUTOMOTIVE-TYPE PLUG

BACKGROUND

The concept of a step-up coil mounted directly on each spark plug of an internal combustion engine is over 50 years old. See, for example, U.S. Pat. Nos. 1,624,951; 1,722,269; 2,033,745; 2,180,358; 2,266,614; 2,414,692; 2,446,888; 2,455,960; 2,459,856; 2,467,531; 2,467,725; 2,482,884; 2,635,202; 3,716,038; 3,935,852; and 4,090,125. The major advantages of such an ignition system are (a) elimination of exposed high tension leads, (b) minimization of the length of the high tension leads thereby reducing losses due to the leakage current and capacitive loading, and (c) inherent safety resulting from the impossibility of disconnecting the coil from the plug with the primary connection plugged in.

However, despite these advantages the use of individual step-up coils with each spark plug of an internal combustion engine has not seen widespread use. One substantial reason has related to heating of the coil. The proximity of the coil (and the insulating materials associated therewith) to the spark plug results in the coil and the insulating materials being subjected to heat coming off of the engine. Modern materials go some distance to overcome this disadvantage. Even so, two other substantial problems remain with integral coils. Breakdown of the spark plug seals allows combustion gases in the engine cylinder to eventually leak to the termination area between the plug and the coil. This creates very high temperatures and pressures which can destroy the coil electrically or even cause mechanical disintegration. In either event, the operator must replace not only the spark plug but the coil. Secondly, there has been a lack of a simple way of verifying that the spark plug is firing when the coil surrounds the terminal atop the spark plug. A common method used with unshielded systems is a neon bulb indicator (see for example, Peters U.S. Pat. No. 2,181,149 and U.S. Pat. No. 2,245,604).

According to this invention there is provided an integral step-up coil spark plug for an internal combustion engine which overcomes the problems of spark plug leakage and enables easy verification that the spark plug is firing.

SUMMARY OF THE INVENTION

An integral spark plug step-up coil according to this invention comprises a typical automotive-type spark plug having additional threads arranged on the metal shell thereof, preferably internal threads in a well on the top of the hex nut portion of the shell. A tubular sleeve threadably engages the shell of the spark plug via the additional threads and extends upwardly along the neck of the spark plug at least as far as the terminal of the spark plug. On top of the sleeve is mounted a canister for containing the step-up coil, typically embedded in epoxy. A standard multiple contact electrical connector is secured to a cap over the top of the coil canister. The sleeve has a radial flange inwardly directed at its end opposite the threaded end thereof. Within the sleeve is a substantially coaxial ceramic bushing having a large diameter portion and a small diameter portion. The small diameter portion extends through the opening in the radial flange of the sleeve. The end of the ceramic bushing abuts the radial flange. The end of the secondary output lead of the coil is attached to a disc-shaped terminal fitted into the small diameter portion of the ceramic bushing. A coil spring connector, for example, bridges the secondary lead terminal and the spark plug terminal.

The sleeve has at least one port in the cylindrical wall thereof near the terminal end of the spark plug neck. The width of the annular space between the sleeve and the ceramic bushing and the axial length of the space are dimensioned so that a flame cannot travel through the space before being quenched. Nevertheless, hot high pressure gases that might escape through the spark plug are vented through the annular quenching space and the port or ports. The ports further provide a location where a firing indicator may be inserted to detect the electrical activity in the secondary circuit of the ignition system associated with the particular spark plug.

THE DRAWING

Further features and other objects and advantages of this invention will become clear from the following detailed description made with reference to the drawing which is a partial section through a step-up coil spark plug combination according to this invention.

DESCRIPTION OF THE PREFERRED EMBODIMENTS

Referring now to the drawing, there is illustrated a spark plug 10 in partial section with an integral coil attached thereto. The spark plug comprises a center electrode 11 with a standard terminal nut 12 at the top exposed end thereof. A tubular ceramic insulator 13 extends substantially the entire length of the electrode. Typically it is comprised of 96% by weight alumina ($Al_2O_3$). A shell 14 surrounds the ceramic insulator and has threads 15 at the lower end for threadably securing the spark plug into the combustion chamber wall. The shell carries an integral hex nut 16 for tightening the plug into the combustion chamber wall. An internal annular gasket or seal 17 fills the space between the shell 10 and the ceramic insulator 13. Yet another internal gasket or seal 18 is located between the electrode and the ceramic insulator. These gaskets or seals must contain the pressure of the combustion chamber. As with all gaskets and seals, they may leak, especially after extensive usage. This slight leakage, while not desirable, does not result in engine shutdown in the normal instance and is simply corrected by the next periodic spark plug change. If spark plugs do leak, very high temperature and pressure gases escape through the spark plug. Any container sealed to the top of the spark plug is then susceptible to being damaged by the gases as by being burst open by internal pressures or simply by having the insulator and other materials thereof damaged due to high temperatures. In the latter instance, when the spark plugs are changed it is also necessary to change the step-up coils.

Referring again to the drawing, the spark gaps are defined by the central electrode 11 and the ground wires 19 attached to the bottom face of the shell 14. The above described spark plug structure is traditional for stationary engines and automotive applications. The neck 20 (comprising portions of the center electrode and the ceramic insulator extending up from the top of the shell to the terminal) serves to protect against arcing from the terminal 12 directly to the shell.

The above described spark plug must be altered slightly for use with an integral coil, specifically, the shell must carry an additional set of threads for threadably engaging the coil assembly with the spark plug. According to a preferred embodiment, the hex nut portion 16 of the shell 14 of the spark plug has a well 21 surrounding the lower portion of the neck. The well has internal threads 22 along the sides of the well. Integral coil spark plugs as described above are commerically available. It would, or course, be equally suitable to provide external threads extending somewhat above the hex nut for attachment of the integral coil assembly.

Threadably secured to the spark plug is an elongate tubular sleeve 30. The sleeve has, in the embodiment illustrated, external threads 31 at the base thereof for engaging the internal threads 22 in the well of the spark plug shell. The tubular sleeve is machined from steel or the like. At the unthreaded end of the outside of the sleeve is an annular recess for receiving a tubular coil canister 34 providing a lap joint which can be braised or welded. Also, at the unthreaded end of the sleeve is a radial flange 35 extending radially inwardly. Adjacent the flange, there is preferably provided an annular recess 36 comprising a portion of the sleeve with an enlarged inner diameter. Ports 38A and 38B, etc. extend outwardly through the side of the sleeve 30 placing the annular recess 36 in communication with the atmosphere.

The length of the tubular sleeve 30 is approximately the length of the neck 20 of the spark plug from the bottom of the well 21 to the top of the terminal 12.

A tubular ceramic bushing 40 having large 41 and smaller 42 diameter axially abutting portions is arranged substantially coaxial with the sleeve 30. The large diameter portion extend substantially the entire axial length of the sleeve 30. The smaller diameter portion 42 extends up through the opening in the radial flange 35 and into the interior of the coil canister 34. The ceramic bushing has an axial end face that bears upon the radial flange 35.

Primary and secondary windings 50 wrapped around a core 51 are positioned within the coil canister 34. Extending downwardly from the winding is a secondary coil output lead 53 which enters the space within the smaller diameter portion of the ceramic bushing. It is desirable if the lead includes a terminal comprising a disc-shaped face 54 which fits snuggly within the bushing. Extending upwardly from the coil are primary input leads 56 and secondary ground lead 57.

The top of the coil canister carries a cap 58 secured thereto by rivet and/or braising or the like. To the cap is secured a standard multiple contact electrical connector 59.

The space within the canister surrounding the coil winding and leads is preferably filled with an epoxy compound.

The annular quenching space between the ceramic bushing 40 and the sleeve 30 is a critical feature of this invention. The width of the annular space and the axial length of the space must be such that no flame can traverse the space before being quenched. The difference in outer diameter of the large diameter portion 41 of the ceramic bushing and the inner diameter of the sleeve 30 must not exceed about 0.020 inches (0.5 millimeters). Also, the axial length of the annular space must not be less than about 1.5 inches (38 millimeters). With these specific dimensions, the quenching space will satisfy the standard for explosion proof enclosures established by the Canadian Standards Association for Class 1, Group D, Hazardous Location Service (CSA Standard C22.2 No. 30-1970). This annular quenching space permits the release of hot high pressure gases leaking from the spark plug and yet insures safety in hazardous atmospheres. Thus, this leakage through the spark plug seal can be safely vented rather than building up destructive pressures and temperatures within the coil canister.

The location of the ports 38A and 38B through the sleeve 30 is especially advantageous for yet another purpose. The ports enable the placement of a firing probe near the secondary output (the spark plug terminal). The firing probe is simply a capacitive pick-up device which causes the illumination of a neon bulb due to the difference in the electrical potential of the hand of the person holding the firing indicator and the space adjacent the spark plug terminal. A much more complex solution to the same problem, that is, the problem of detecting the electrical activity in the secondary circuit, is illustrated in U.S. Pat. No. 4,090,125.

Having thus described this invention with the detail and particularity required by the Patent Laws, what is desired protected by Letters Patent is set forth in the following claims.

I claim:

1. In an ignition device comprising a step-up coil unit to be associated with a spark plug, the improvement comprising said step-up coil unit comprising an elongate tubular metal sleeve having means at one end for engaging the shell of the spark plug, said sleeve having at least one radial port through the side of the sleeve an insulating bushing arranged substantially coaxial within the sleeve, and a coil canister sealed to said sleeve having a coil therein, the difference between the inner diameter of the metal sleeve and the outer diameter of the insulating bushing defining a narrow annular gap sized to quench a flame attempting to propagate therethrough, whereby upon leakage of the seals in the spark plug the pressure does not build up in the coil canister but is released through the gap between the sleeve and the bushing and through the ports in the sleeve and whereby the condition of the spark plug can be checked by inserting a firing probe in the said at least one port.

2. The invention set forth in claim 1 wherein there is an annular recess in the inner diameter of the metal sleeve in the vicinity of the at least one port.

3. The invention set forth in claim 1 wherein the length and width of the narrow annular gap is sized to satisfy explosion-proof standards.

4. The invention set forth in claim 1 wherein the narrow annular gap is no more than about 0.020 inches wide and the axial length is at least 1.5 inches.

* * * * *